US005592152A

United States Patent [19]

Huang

[11] Patent Number: 5,592,152

[45] Date of Patent: Jan. 7, 1997

[54] INTRUDER DETECTING DEVICE TO BE INSTALLED IN AN INTEGRATED RAISED FLOORING SYSTEM

[76] Inventor: Chien-Teh Huang, Fan-Po-Lin No. 47-1, San-Chi Hsiang, Taipei Hsien, Taiwan

[21] Appl. No.: 533,004

[22] Filed: Sep. 25, 1995

[51] Int. Cl.[6] ..... G08B 21/00

[52] U.S. Cl. ..... 340/666; 340/541; 200/86 R; 200/61.93

[58] Field of Search ..... 340/541, 665, 340/666, 667; 200/85 R, 86.5, 82 R, 86 R, 61.93, 81 R

[56] References Cited

U.S. PATENT DOCUMENTS

| | | | |
|---|---|---|---|
| 700,027 | 5/1902 | Emory | 340/541 |
| 940,535 | 11/1909 | Korbel | 200/86 R |
| 1,101,999 | 6/1914 | Clark | 340/541 |
| 1,181,420 | 5/1916 | Williams | 340/541 |
| 1,645,875 | 10/1927 | Scarborough | 200/86 R |
| 3,346,866 | 10/1967 | Bechtel | 346/40 |
| 3,530,432 | 9/1970 | Pope | 340/940 |
| 3,533,095 | 10/1970 | Collins | 200/85 R |
| 3,596,024 | 7/1971 | Smith et al. | 200/86 R |
| 3,646,512 | 2/1972 | Borgstede | 340/440 |
| 3,696,372 | 10/1972 | Garrett et al. | 182/18 |
| 3,794,789 | 2/1974 | Bynum | 200/82 R |
| 3,825,277 | 7/1974 | Steinback | 200/86 R |
| 4,311,889 | 1/1982 | Blanchard et al. | 200/50 R |
| 4,538,142 | 8/1985 | Hamilton et al. | 340/667 |
| 4,727,352 | 2/1988 | Doller | 340/665 |
| 5,057,819 | 10/1991 | Valenti | 340/573 |
| 5,069,513 | 12/1991 | Farrell et al. | 312/201 |
| 5,159,832 | 11/1992 | White | 73/151 |
| 5,185,595 | 2/1993 | Friesen | 340/690 |
| 5,341,132 | 8/1994 | Dorey et al. | 340/932.2 |

*Primary Examiner*—Jeffery A. Hofsass
*Assistant Examiner*—Benjamin C. Lee
*Attorney, Agent, or Firm*—Knobbe, Martens, Olson & Bear

[57] ABSTRACT

An intruder detecting device, which is to be installed in an integrated raised flooring system that includes a floor panel assembly and a plurality of pedestals for supporting the floor panel assembly on a base floor, has a housing, a restoring member, a switch unit and a piston. The housing includes a lower housing part and an upper housing part disposed coaxially and connected slidably and sealingly to the lower housing part so as to confine a sealed chamber therewith. The lower housing part is adapted to be disposed on one of the pedestals. The upper housing part is adapted to support the floor panel assembly thereon and is formed with an air hole and a hollow piston guide which opens downwardly and which is aligned axially with the air hole. The sealed chamber contains hydraulic fluid therein. The restoring member is disposed in the sealed chamber to bias the upper housing part away from the lower housing part. The switch unit is mounted on the lower housing part and has a resilient switch contact which extends into the sealed chamber and which is aligned with the piston guide. The piston extends slidably and sealingly into the piston guide, and abuts normally against the switch contact to deactivate the switch unit.

13 Claims, 6 Drawing Sheets

INTRUDER DETECTING DEVICE TO BE INSTALLED IN AN INTEGRATED RAISED FLOORING SYSTEM

BACKGROUND OF THE INVENTION

1. Field of the Invention

The invention relates to an intruder detecting device, more particularly to an intruder detecting device which is to be installed in an integrated raised flooring system.

2. Description of the Related Art

Integrated raised flooring systems are used extensively in computer and control rooms and in laboratory rooms. Referring to FIGS. 1 and 2, a conventional integrated raised flooring system is shown to comprise a floor panel assembly 1, which includes a grid system of structural beams 12 that supports an array of rectangular floor panels 10 thereon, and a plurality of pedestals 11 for supporting the floor panel assembly 1 on a base floor (not shown). The floor panel assembly 1 cooperates with the base floor to form a plenum which is used for concealing electrical wiring and the like. Usually, each of the four corner portions of one floor panel 10 is supported on and occupies one-fourth of a load bearing area of a respective pedestal 11. Thus, adjacent corner portions of four floor panels 10 are equally supported on one pedestal 11.

In most office buildings, the detection of unauthorized entry in some rooms is of utmost concern. Thus, there is always a need to develop intruder detecting devices which can effectively detect the presence of an intruder.

SUMMARY OF THE INVENTION

The object of the present invention is to provide a highly sensitive and precise intruder detecting device which can be installed in a conventional integrated raised flooring system and which can effectively detect the presence of an intruder.

According to the present invention, an intruder detecting device is to be installed in an integrated raised flooring system which includes a floor panel assembly and a plurality of pedestals that support the floor panel assembly on a base floor. The intruder detecting device comprises:

- a housing including a lower housing part and an upper housing part disposed coaxially and connected slidably and sealingly to the lower housing part so as to confine a sealed chamber therewith, the lower housing part being adapted to be disposed on one of the pedestals, the upper housing part being adapted to support the floor panel assembly thereon, the upper housing part being formed with an air hole and a hollow piston guide which opens downwardly and which is aligned axially with the air hole, the sealed chamber containing hydraulic fluid therein;
- at least one restoring member disposed in the sealed chamber to bias the upper housing part away from the lower housing part;
- a switch unit mounted on the lower housing part and having a resilient switch contact which extends into the sealed chamber and which is aligned with the piston guide; and
- a piston extending slidably and sealingly into the piston guide, the piston abutting normally against the switch contact to deactivate the switch unit.

The presence of an intruder results in an increase in the load applied on the floor panel assembly, thereby causing the floor panel assembly to apply downward pressure on the upper housing part of the housing so as to move the upper housing part toward the lower housing part and cause the hydraulic fluid in the sealed chamber to move the piston further into the piston guide and away from the switch contact to activate the switch unit.

The switch unit is adapted to be connected electrically to an alarm generating unit so as to actuate the alarm generating unit in order to generate an alarm signal when the switch unit is activated.

In one embodiment, the lower housing part includes a plate body and a surrounding wall extending upwardly from a periphery of the plate body. The upper housing part includes a cover plate and a surrounding wall extending downwardly from a periphery of the cover plate. The surrounding wall of the lower housing part extends into the upper housing part and is in sliding and sealing contact with the surrounding wall of the upper housing part.

In another embodiment, the lower housing part includes a plate body and a surrounding wall extending upwardly from a periphery of the plate body. The upper housing part has a bottom portion which extends into the lower housing part and which is in sliding and sealing contact with the surrounding wall of the lower housing part.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENTS

Figure 1:
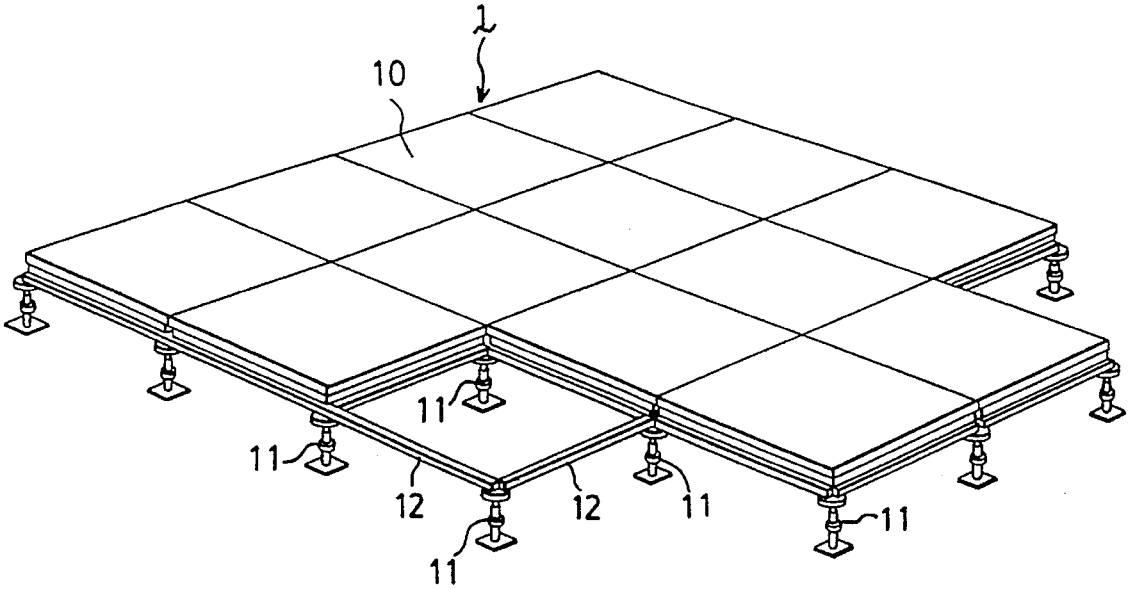
FIG.1 PRIOR ART
FIG. 1 is a perspective view of a conventional integrated raised flooring system.

Before the present invention is described in greater detail, it should be noted that like elements are denoted by the same reference numerals throughout the specification.

Figure 2:
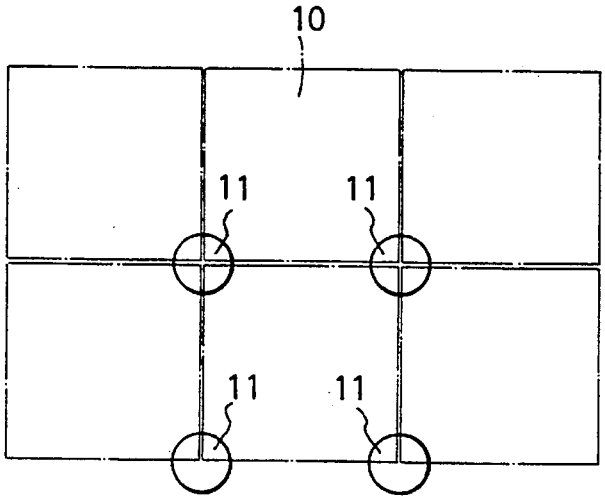
FIG.2 PRIOR ART
FIG. 2 is a top view of a portion of the conventional integrated raised flooring system.

Referring again to FIGS. 1 and 2, when a person steps on one of the floor panels 10, the weight of the person is transmitted to the pedestals 11 which support said one of the floor panels 10. Thus, the device of the present invention may be incorporated on some of the pedestals 11 of the conventional integrated raised flooring system so as to detect a change in the load applied on the floor panel assembly 1 and borne by the pedestals 11 to detect, in turn, the presence of an intruder.

Figure 3:
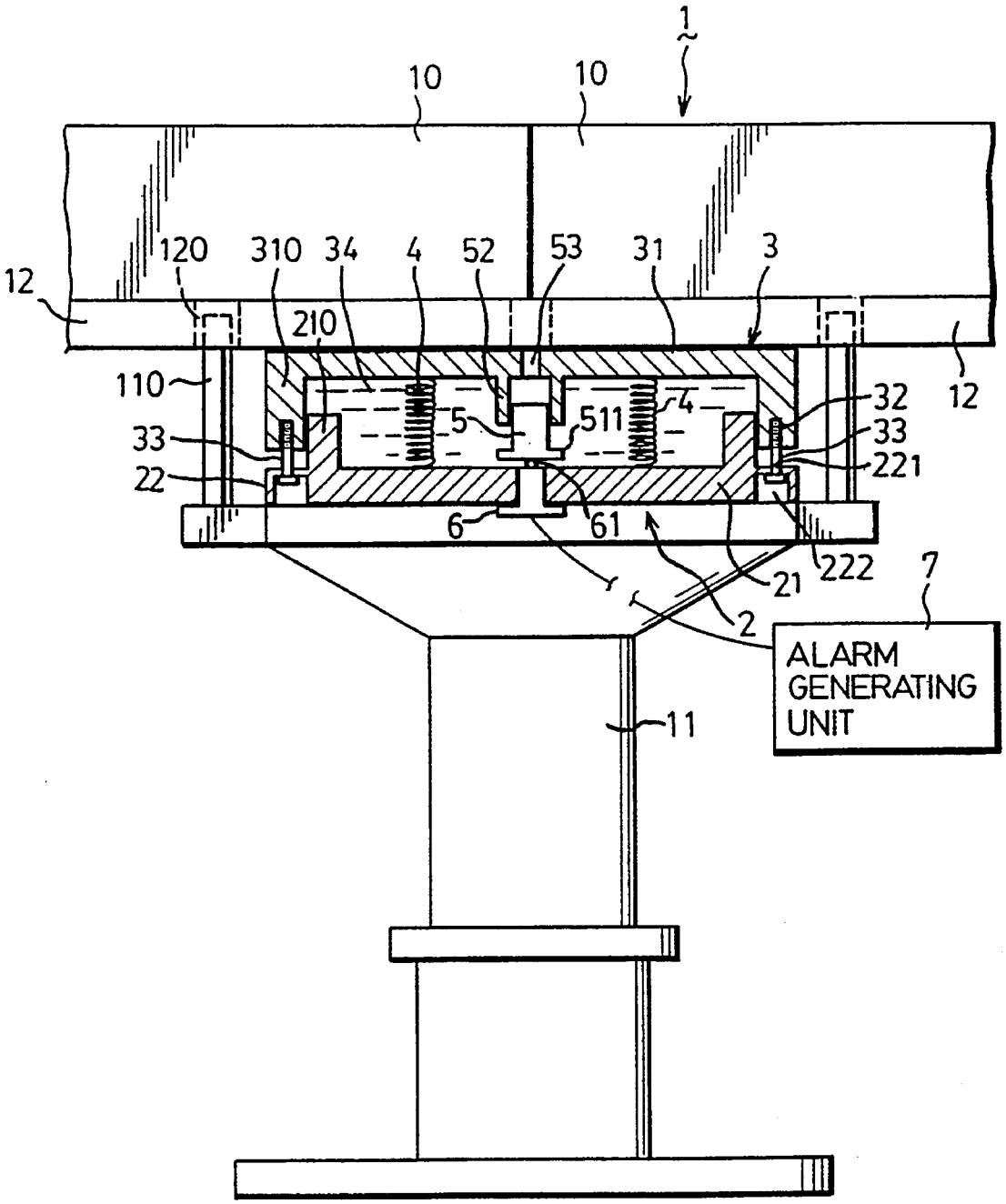
FIG. 3 is a schematic, partly sectional view of the first preferred embodiment of an intruder detecting device according to the present invention, the intruder detecting device being installed on a pedestal of a conventional integrated raised flooring system.
Figure 4:
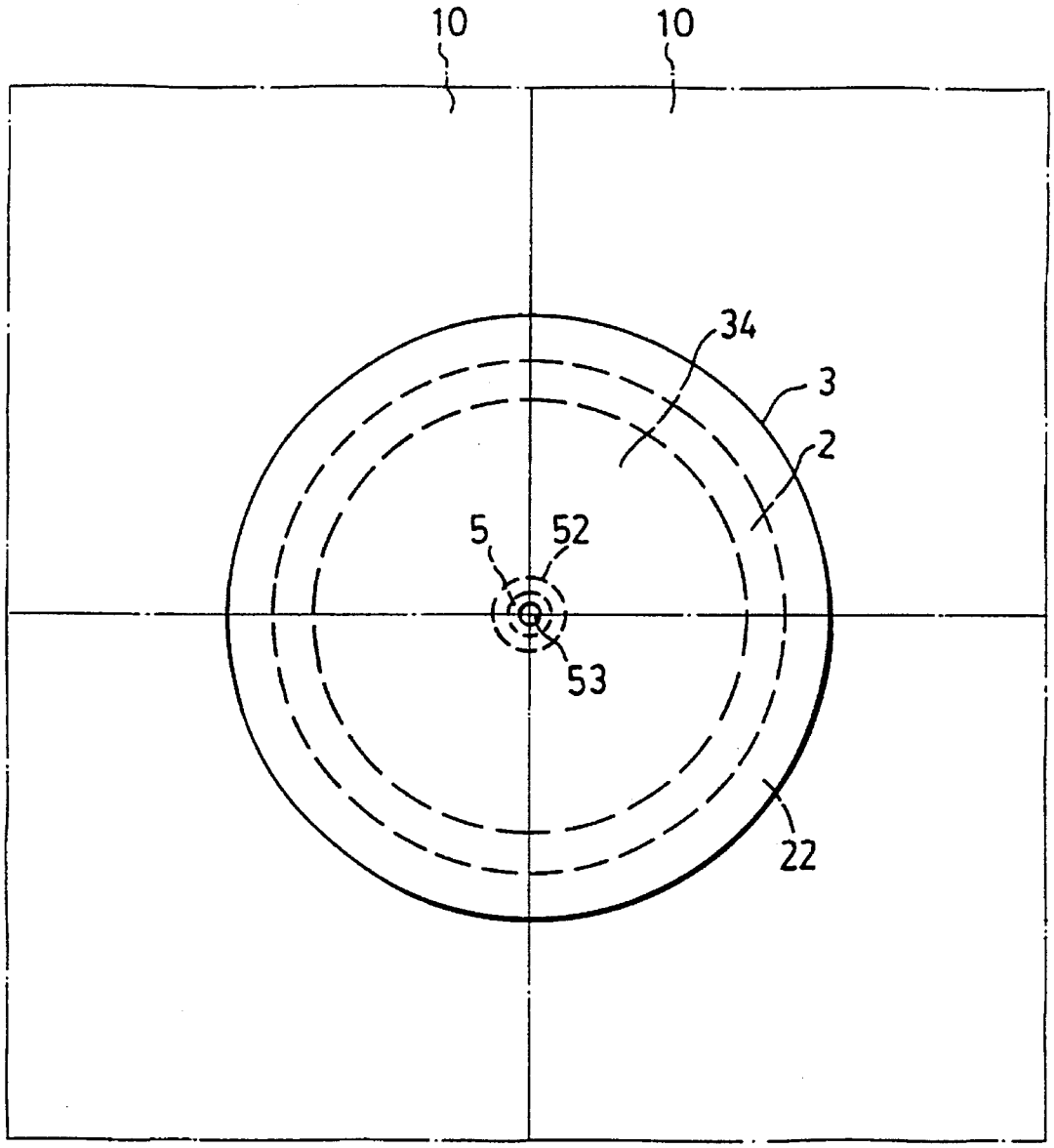
FIG. 4 is a top view illustrating the first preferred embodiment when installed in a conventional integrated raised flooring system.

Referring to FIGS. 3 and 4, the first preferred embodiment of an intruder detecting device according to the present invention is shown to comprise a housing, at least one restoring member 4, a piston 5 and a switch unit 6.

The housing includes a lower housing part 2 and an upper housing part 3 that is disposed coaxially and that is connected slidably and sealingly to the lower housing part 2 so as to confine a sealed chamber 34 therewith. The lower housing part 2 is disposed on one of the pedestals 11, while the upper housing part 3 supports the floor panel assembly 1 thereon. In this embodiment, the lower housing part 2 includes a plate body 21 and a surrounding wall 210 that extends upwardly from a periphery of the plate body 21. The upper housing part 3 includes a cover plate 31 and a surrounding wall 310 that extends downwardly from a periphery of the cover plate 31. The surrounding wall 210 of the lower housing part 2 extends into the upper housing part 3 and is in sliding and sealing contact with the surrounding wall 310 of the upper housing part 3. The surrounding wall 210 of the lower housing part 2 has a bottom portion formed with a retaining flange 22 that extends radially and outwardly. The retaining flange 22 is formed with at least one pair of diametrically opposite through-holes 221 and has a bottom side formed with a recess 222 that is aligned with the through-holes 221. The surrounding wall 310 of the upper housing part 3 has a bottom side formed with at least one pair of diametrically opposite screw holes 32 that are aligned with the through-holes 221 in the retaining flange 22. Each of at least one pair of screw fasteners 33 has a head portion received in the recess 222 of the retaining flange 22 and a threaded shank portion that extends through a respective one of the through-holes 221 in the retaining flange 22 and that engages threadedly a respective one of the screw holes 32 in the surrounding wall 310 of the upper housing part 3.

The upper housing part 3 is formed with an air hole 53 and a hollow piston guide 52 which opens downwardly and which is aligned axially with the air hole 53. Preferably, the air hole 53 and the piston guide 52 are aligned axially with axes of the lower and upper housing parts 2, 3. In addition, the sealed chamber 34 contains hydraulic fluid therein.

In this embodiment, there are two restoring members 4, which are in the form of coil springs, disposed in the sealed chamber 34 on two sides of the piston guide 52. The restoring members 4 serve to bias the upper housing part 3 away from the lower housing part 2. If more than one restoring member 4 is in use, the restoring members 4 must be capable of uniformly biasing the upper housing part 3. If only one restoring member 4 is in use, the restoring member 4 must be coaxial with the lower and upper housing parts 2, 3.

The switch unit 6 is mounted on the lower housing part 2 and has a resilient switch contact 61 which extends into the sealed chamber 34 and which is aligned with the piston guide 52. The switch unit 6 is connected electrically to an alarm generating unit 7 and actuates the latter in order to generate an alarm signal when the switch unit 6 is activated.

The piston 5 extends slidably and sealingly into the piston guide 52, and abuts normally against the switch contact 61 to deactivate the switch unit 6. The piston 5 has a bottom end formed with a radial limit flange 511.

The structural beams 12 of the floor panel assembly 1 are formed with pin holes 120 which permit extension of positioning pins 110 on the pedestal 11 therethrough, thereby-connecting the floor panel assembly 1 to the pedestal 11 in a known manner. Such a connection permits slight vertical movement of the floor panel assembly 1 relative to the pedestal 11.

Figure 5:
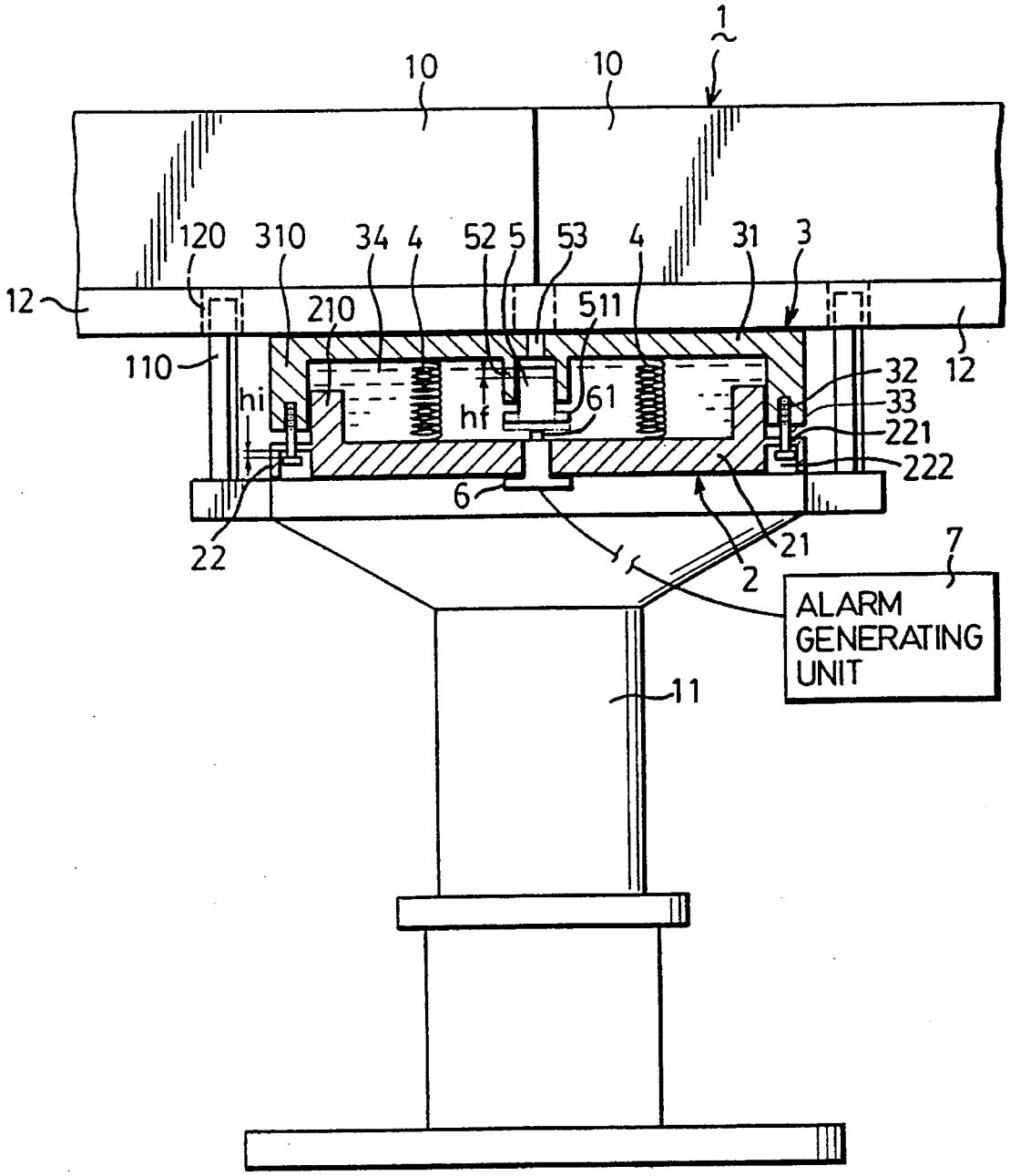
FIG. 5 is a schematic, partly sectional view illustrating how the first preferred embodiment detects the presence of an intruder.

Referring to FIG. 5, when an intruder steps on the floor panel assembly 1, his weight increases the load applied on the floor panel assembly 1. Under this condition, the floor panel assembly 1 applies downward pressure on the upper housing part 3 of the housing, thereby resulting in movement of the upper housing part 3 toward the lower housing part 2 by a distance (hi). The hydraulic fluid in the sealed chamber 34 is compressed and pushes the piston 5 to move further into the piston guide 52 by a distance (hf) which is larger than the distance (hi) until the limit flange 511 abuts against the distal end of the piston guide 52. The piston 5 ceases to abut against the switch contact 61, thereby activating the switch unit 6. The switch unit 6 actuates the alarm generating unit 7 at this time in order to generate an alarm signal which indicates the presence of an intruder.

The restoring members 4 permit the application of a predetermined load on the floor panel assembly 1 without causing untimely activation of the switch unit 6. Thus, the characteristics of the restoring members 4 determine the precision of the intruder detecting device of the present invention. In addition, when the additional load, i.e. the weight of the intruder, is removed from the floor panel assembly 1, the restoring members 4 expand to move the upper housing part 3 away from the lower housing part 2 and cause the piston 5 to once more abut against the switch contact 61 of the switch unit 6, thereby deactivating the latter.

Figure 6:
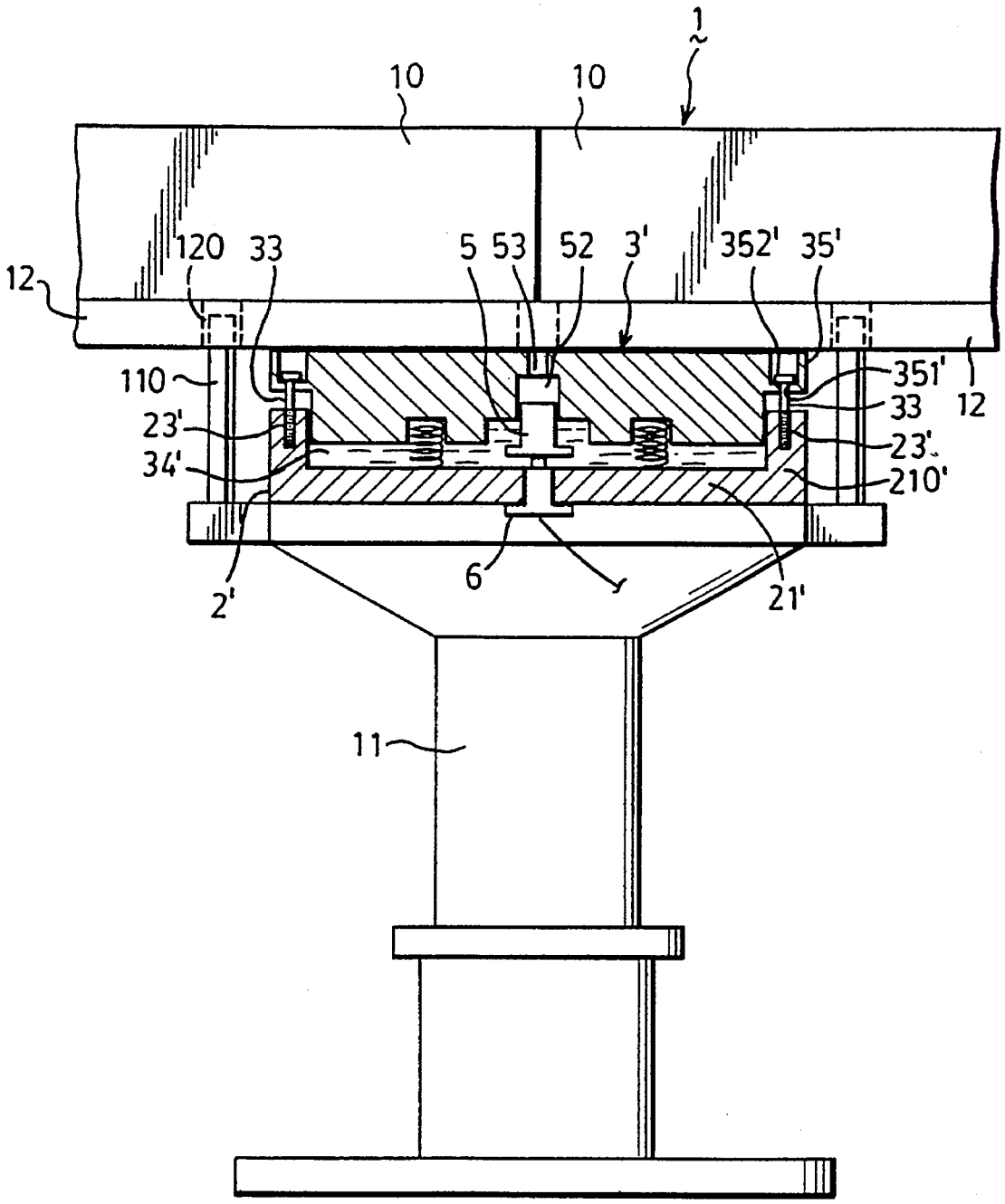
FIG. 6 is a schematic, partly sectional view of the second preferred embodiment of an intruder detecting device according to the present invention, the intruder detecting device being installed on a pedestal of a conventional integrated raised flooring system.

FIG. 6 illustrates the second preferred embodiment of an intruder detecting device according to the present invention. The intruder detecting device of this embodiment is generally similar to the previous embodiment, the main difference residing in the construction of the housing. As shown, the housing of the second preferred embodiment also includes lower and upper housing parts 2', 3' which confine a sealed chamber 34' that has hydraulic fluid contained therein. As with the previous embodiment, the upper housing part 3' is formed with an air hole 53 and a hollow piston guide 52' which opens downwardly and which is aligned axially with the air hole 53. In this embodiment, the lower housing part 2' includes a plate body 21' and a surrounding wall 210' that extends upwardly from a periphery of the plate body 21'. The upper housing part 3' has a bottom portion which extends into the lower housing part 2' and which is in sliding and sealing contact with the surrounding wall 210' of the lower housing part 2'. The surrounding wall 210' of the lower housing part 2' has a top side formed with at least one pair of diametrically opposite screw holes 23'. The upper housing part 3' has a top portion formed with a retaining flange 35' which extends radially and outwardly and which is formed with at least one pair of diametrically opposite through-holes 351' that are aligned with the screw holes 23'. The retaining flange 35' has a top side formed with a recess 352' that is aligned with the through-holes 351'. Each of at least one pair of screw fasteners 33 has a head portion received in the recess 352' of the retaining flange 35' and a threaded shank portion that extends through a respective one of the through-holes 351' in the retaining flange 35' and that engages threadedly a respective one of the screw holes 23' in the surrounding wall 210' of the lower housing part 2'. The operation of the second preferred embodiment is similar to that of the previous embodiment and will not be detailed further. The second preferred embodiment, however, provides a smaller sealed chamber 34' to result in a smaller hydraulic fluid requirement.

Figure 7:
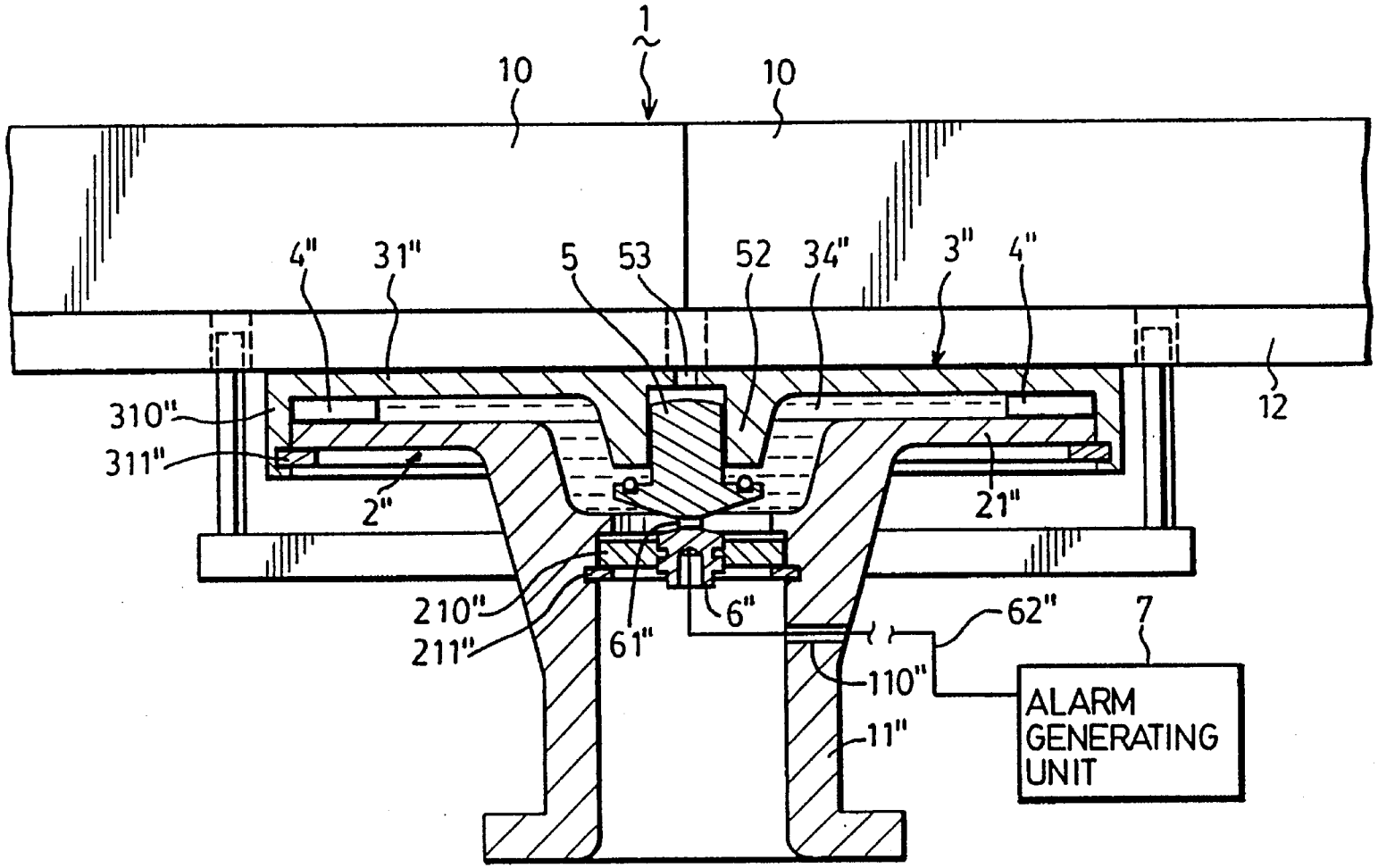
FIG. 7 is a schematic, partly sectional view of a pedestal which incorporates the third preferred embodiment of an intruder detecting device according to the present invention, the pedestal supporting floor panels thereon.

Referring to FIG. 7, the third preferred embodiment of an intruder detecting device according to the present invention is shown to be incorporated on a pedestal 11". In this embodiment, the pedestal 11" includes a hollow cylindrical pedestal body which has a plate body 210" disposed therein. A C-shaped locking ring 211" retains the plate body 210" in the pedestal 11". The pedestal 11" has a portion above the plate body 210" which serves as a lower housing part 2". The lower housing part 2" has a top end formed with a radial outward flange 21". An upper housing part 3" is disposed coaxially and is connected slidably and sealingly to the lower housing part 2" so as to confine a sealed chamber 34" therewith. The upper housing part 3" supports the floor panel assembly 1 thereon, and includes a cover plate 31" and a surrounding wall 310" that extends downwardly from a periphery of the cover plate 31" and that is in sliding and sealing contact with a periphery of the flange 21". The surrounding wall 310" has a distal end portion with a C-shaped retaining ring 311" that is secured to an inner wall surface thereof and that serves as an inward limit flange to prevent removal of the upper housing part 3" from the lower housing part 2".

As with the previous embodiments, the upper housing part 3" is formed with an air hole 53 and a hollow piston guide 52 which opens downwardly and which is aligned axially with the air hole 53. In addition, the sealed chamber 34" contains hydraulic fluid therein.

In this embodiment, there are two restoring members 4", which are in the form of resilient blocks, disposed in the sealed chamber 34" on two sides of the piston guide 52. The restoring members 4" serve to bias the upper housing part 3" away from the lower housing part 2".

A switch unit 6" is mounted on the plate body 210" of the lower housing part 2" and has a resilient switch contact 61" which extends into the sealed chamber 34" and which is aligned with the piston guide 52". The switch unit 6" is connected electrically to an alarm generating unit 7 by means of a cable 62" which extends out of the pedestal 11" via a radial hole 110" formed in the latter. The switch unit 6" is capable of actuating the alarm generating unit 7 in order to generate an alarm signal when the switch unit 6" is activated. A piston 5 extends slidably and sealingly into the piston guide 52, and abuts normally against the switch contact 61" to deactivate the switch unit 6".

The operation of the third preferred embodiment is similar to that of the previous embodiments and will not be described herein. In addition, the floor panel assembly 1 is connected to the pedestal 11" in a manner similar to that employed in the previous embodiments and will not be detailed further.

The advantages and characterizing features of the intruder detecting device of the present invention are as follows:

1. As mentioned beforehand, a slight downward movement of the upper casing part 3 results in a larger upward movement of the piston 5. Thus, the intruder detecting device is capable of effectively detecting the presence of an intruder.
2. The intruder detecting device is installed beneath the floor panel assembly 1 and is not visible to an intruder.
3. Since the pedestals 11 are adjustable in height, the floor panel assembly 1 remains flush even after the intruder detecting device has been installed.
4. The intruder detecting device may be incorporated on all of the pedestals 11 or on selected ones of the pedestals 11, depending upon the requirements of the user.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. An intruder detecting device to be installed in an integrated raised flooring system, the flooring system including a floor panel assembly and a plurality of pedestals which support the floor panel assembly on a base floor, said intruder detecting device comprising:

a housing including a lower housing part and an upper housing part disposed coaxially and connected slidably and sealingly to said lower housing part so as to confine a sealed chamber therewith, said lower housing part being adapted to be disposed on one of the pedestals, said upper housing part being adapted to support the floor panel assembly thereon, said upper housing part being formed with an air hole and a hollow piston guide which opens downwardly and which is aligned axially with said air hole, said sealed chamber containing hydraulic fluid therein;

at least one restoring member disposed in said sealed chamber to bias said upper housing part away from said lower housing part;

a switch unit mounted on said lower housing part and having a resilient switch contact which extends into said sealed chamber and which is aligned with said piston guide; and a piston extending slidably and sealingly into said piston guide, said piston abutting normally against said switch contact to deactivate said switch unit;

whereby, an increase in load applied on the floor panel assembly causes the floor panel assembly to apply downward pressure on said upper housing part of said housing, thereby resulting in movement of said upper housing part toward said lower housing part to cause said hydraulic fluid in said sealed chamber to move said piston further into said piston guide and away from said switch contact to activate said switch unit.

2. The intruder detecting device as claimed in claim 1, wherein said switch unit is adapted to be connected electrically to an alarm generating unit so as to actuate the alarm generating unit in order to generate an alarm signal when said switch unit is activated.

3. The intruder detecting device as claimed in claim 1, wherein said air hole and said piston guide are aligned axially with axes of said lower and upper housing parts.

4. The intruder detecting device as claimed in claim 1, wherein said piston has a bottom end formed with a radial limit flange.

5. The intruder detecting device as claimed in claim 1, wherein said lower housing part includes a plate body and a surrounding wall extending upwardly from a periphery of said plate body, said upper housing part including a cover plate and a surrounding wall extending downwardly from a periphery of said cover plate, said surrounding wall of said lower housing part extending into said upper housing part and being in sliding and sealing contact with said surrounding wall of said upper housing part.

6. The intruder detecting device as claimed in claim 5, wherein:

said surrounding wall of said lower housing part has a bottom portion formed with a retaining flange that extends radially and outwardly, said retaining flange being formed with at least one pair of diametrically opposite through-holes and having a bottom side formed with a recess that is aligned with said through-holes;

said surrounding wall of said upper housing part has a bottom side formed with at least one pair of diametrically opposite screw holes that are aligned with said through-holes in said retaining flange; and said housing further includes at least one pair of screw fasteners, each having a head portion received in said recess of said retaining flange and a threaded shank portion that extends through a respective one of said through-holes in said retaining flange and that engages threadedly a respective one of said screw holes in said surrounding wall of said upper housing part.

7. The intruder detecting device as claimed in claim 1, wherein said lower housing part includes a plate body and a surrounding wall extending upwardly from a periphery of said plate body, said upper housing part having a bottom portion which extends into said lower housing part and which is in sliding and sealing contact with said surrounding wall of said lower housing part.

8. The intruder detecting device as claimed in claim 7, wherein:

said surrounding wall of said lower housing part has a top side formed with at least one pair of diametrically opposite screw holes;

said upper housing part has a top portion formed with a retaining flange that extends radially and outwardly, said retaining flange being formed with at least one pair of diametrically opposite through-holes that are aligned with said screw holes and having a top side formed with a recess that is aligned with said through-holes; and said housing further includes at least one pair of screw fasteners, each having a head portion received in said recess of said retaining flange and a threaded shank portion that extends through a respective one of said through-holes in said retaining flange and that engages threadedly a respective one of said screw holes in said surrounding wall of said lower housing part.

9. A pedestal with an intruder detecting capability for supporting a floor panel assembly of an integrated raised flooring system on a base floor, said pedestal comprising:

a pedestal body having an upper portion formed integrally with a lower housing part;

an upper housing part disposed coaxially and connected slidably and sealingly to said lower housing part so as to confine a sealed chamber therewith, said upper housing part being adapted to support the floor panel assembly thereon, said upper housing part being formed with an air hole and a hollow piston guide which opens downwardly and which is aligned axially with said air hole, said sealed chamber containing hydraulic fluid therein;

at least one restoring member disposed in said sealed chamber to bias said upper housing part away from said lower housing part;

a switch unit mounted on said lower housing part and having a resilient switch contact which extends into said sealed chamber and which is aligned with said piston guide; and a piston extending slidably and sealingly into said piston guide, said piston abutting normally against said switch contact to deactivate said switch unit;

whereby, an increase in load applied on the floor panel assembly causes the floor panel assembly to apply downward pressure on said upper housing part, thereby resulting in movement of said upper housing part toward said lower housing part to cause said hydraulic fluid in said sealed chamber to move said piston further into said piston guide and away from said switch contact to activate said switch unit.

10. The pedestal as claimed in claim 9, wherein said switch unit is adapted to be connected electrically to an alarm generating unit so as to actuate the alarm generating unit in order to generate an alarm signal when said switch unit is activated.

11. The pedestal as claimed in claim 9, wherein said air hole and said piston guide are aligned axially with axes of said lower and upper housing parts.

12. The pedestal as claimed in claim 9, wherein said lower housing part has a top end formed with a radial outward flange, said upper housing part including a cover plate and a surrounding wall that extends downwardly from a periphery of said cover plate and that is in sliding and sealing contact with a periphery of said flange of said lower housing part.

13. The pedestal as claimed in claim 12, wherein said surrounding wall of said upper housing part has a distal end portion formed with an inward limit flange to prevent removal of said upper housing part from said lower housing part.

* * * * *